US007063527B2

(12) United States Patent
Clifford et al.

(10) Patent No.: US 7,063,527 B2
(45) Date of Patent: Jun. 20, 2006

(54) BURNER PLAQUE WITH CONTINUOUS CHANNELS

(75) Inventors: Callum Clifford, Leeds (GB); Edward Hart, Leeds (GB); Graham Wood, Leeds (GB)

(73) Assignee: Sit-Bray Limited, Leeds (GB)

( * ) Notice: Subject to any disclaimer, the term of this patent is extended or adjusted under 35 U.S.C. 154(b) by 84 days.

(21) Appl. No.: 10/111,309

(22) PCT Filed: Dec. 11, 2000

(86) PCT No.: PCT/GB00/04728

§ 371 (c)(1),
(2), (4) Date: Jul. 30, 2002

(87) PCT Pub. No.: WO01/42709

PCT Pub. Date: Jun. 14, 2001

(65) Prior Publication Data

US 2003/0138749 A1 Jul. 24, 2003

(30) Foreign Application Priority Data

Dec. 11, 1999 (GB) ..... 9929257

(51) Int. Cl.
*F23D 3/40* (2006.01)

(52) U.S. Cl. ..... 431/326; 431/170; 431/328

(58) Field of Classification Search ..... 431/328, 431/326, 170, 329; 126/92 R, 92 AC
See application file for complete search history.

(56) References Cited

U.S. PATENT DOCUMENTS

| | | | | | |
|---|---|---|---|---|---|
| 3,683,058 | A | * | 8/1972 | Partiot et al. | 264/156 |
| 3,825,403 | A | * | 7/1974 | Gottschall | 431/328 |
| 3,954,387 | A | * | 5/1976 | Cooper | 431/328 |
| 4,508,502 | A | * | 4/1985 | Itoh | 431/328 |
| 5,417,566 | A | * | 5/1995 | Ishikawa et al. | 431/328 |

FOREIGN PATENT DOCUMENTS

| | | | |
|---|---|---|---|
| DE | 94 02 556 U | * | 4/1994 |
| EP | 0 810 404 A | * | 12/1997 |
| JP | 60-086317 | * | 5/1985 |

* cited by examiner

*Primary Examiner*—James C. Yeung
(74) *Attorney, Agent, or Firm*—Nixon Peabody LLP

(57) ABSTRACT

A ceramic burner plaque is described being of a predetermined thickness defined between first and second planar surfaces and through which a plurality of burner ports (6) pass from one surface to the other. The ports are arranged in offset rows and a plurality of polygonal channels (10) are cut into the second surface (8) of the plaque, said channels also being arranged in offset fashion rows and being of a depth less than the thickness of the plaque. The channels are ideally octogonal in shape and of a width which widens progressively from the narrow base of the channel within the thickness of the plaque towards the second surface. The width of the channels at their base is ideally similar or marginally greater to the dimensions of the burner ports and the shape and position of the channels is such that a plurality of burner ports are coincidental with the base thereof.

13 Claims, 5 Drawing Sheets

BURNER PLAQUE WITH CONTINUOUS CHANNELS

This application is national stage application under 35 U.S.C §371 of PCT/GB00/04728, filed Dec. 11, 2000, which claims priority benefit of GB 9929257.5, filed Dec. 11, 1999.

FIELD OF THE INVENTION

This invention relates to an improved burner plaque, and more specifically to an improved burner plaque for use in conventional fully pre-mix burners of the type which are commonly in use on domestic, commercial and industrial boilers. Moreover, the invention also relates to an integrated burner plaque and distribution plate configuration.

BACKGROUND OF THE INVENTION

Although the following description relates almost exclusively to plaques ideally adapted for use in fully pre-mix burner applications, it is to be mentioned that the configuration of the burner plaque of the present invention renders said plaque utile in different applications, for example non-pre-mix and normally aspirated applications, and the invention should not be considered as limited by the following description.

Fully pre-mixed burners are so-called because the fuel, usually gas (under denominations for reference gases and test gases identified in European Standard EN 437), and a fan supplied quantity of air exceeding the stoichiometrically correct amount of air for the specific gas type (superstoichiometric) are mixed to produce a combustible mixture which subsequently is ignited to produce a burner flame that, in the case of heating the water in a boiler, is applied to a heat exchanger of the boiler. The term pre-mixed arises therefore because of the mixing of the fuel and air before the flame strip.

There are other types of burner which operate in a mode in which a sub-stoichiometric amount of primary combustion air is mixed with the fuel before the flame strip, secondary air required for completing the combustion process being induced into the flame after ignition of the gas/primary air mixture. These other burners are known as partially pre-mixed burners. The present invention may be applicable to fan-assisted models of such burners, but its best application is to the fully pre-mixed type, as partially pre-mixed burners are limited by the relatively high levels of nitrogen oxides (NOx) they generate during the combustion process and as such, these burners are diminishing in popularity.

Fully premixed burners tend to be high intensity burners in which high volumes of gas/air mixture are forced through a relatively small plan area burner, and specifically through the ports in a burner plaque to give a compact, high intensity flamestrip which sits on or near the face of said plaque. They can be fired in any orientation and are used in most condensing boilers where the burner fires downwards into the heat exchanger.

The high volume of the gas/air flow being fan driven through the small area burner means there is a high "port-loading" on each individual burner port provided in the plaque. The fact that a compressible medium flows through the burner system at a certain velocity means that any instabilities created on ignition of said medium are amplified and can ultimately develop a common frequency which constructively harmonises with the natural frequency of the boiler system to generate a phenomenon called combustion resonance. Resonance of any audible volume or frequency is unacceptable for pre-mixed burner applications.

The boiler system comprises the combustion chamber, the heat exchanger which will occupy a predetermined position within said combustion chamber, and a flue attached to said chamber to vent the exhaust gases of combustion. Any variance of these parameters will influence the harmonics of the system e.g. varying the flue length will change the back pressure on the combustion chamber.

The combustion resonance is manifested as three distinct types of resonance:

1. A low frequency (125 to 200 Hz) rumble on ignition; This is believed to be due to flame instabilities caused by poor gas/air mixing, bad gas/air mixture distribution and poorly timed ignition, such being associated with the burner appliance design factors of upstream mixing of gas and air, position of ignitor etc.

2. A higher frequency (250 to 315 Hz) resonance on ignition at volumes up to 95 dB; Under standard repeat ignition conditions the flame ignites and thermally fluctuates initially as it stabilises near the port. The differential pressures and temperatures created initially in the system exacerbate this instability creating a range of oscillating and fluctuating frequencies of flame vibration, some of which may harmonise and thus be amplified at one or more of the natural resonance frequencies bands of the system. However, once the system has been operational for approximately a minute, these instabilities dissipate and the resonance fades out.

The propensity of boiler systems to develop resonance increases when the system is cold prior to ignition. The energy of the ignition combustion wave within the system is dissipated as it spreads away from the ignition source and comes into contact with the cold surfaces of the system, which further reduce the velocity of the flame front. This results in a temperature differential between the area close to the ignitor and at the far end of the burner giving rise to a horizontal pressure wave which interacts with the oscillating thermal fluctuations described above to destabilise the flame and also to increase the propensity for fluctuations over a broad range of frequencies. This broad fluctuation range increases the likelihood of harmonisation and amplification at one of the natural vibration frequencies of the system. This resonance is not fully temperature dependent and is directly influenced by the burner plaque and distribution plate designs.

3. A continuous high frequency resonance can develop once the flames have stabilised. This can arise from instabilities caused by ignition resonance and which are continuously excited by virtue of the gas/air flow movements within the system during operation, or by the inherent excitations developed by virtue of the burner design.

DETAILED DESCRIPTION OF THE INVENTION

Figure 1:
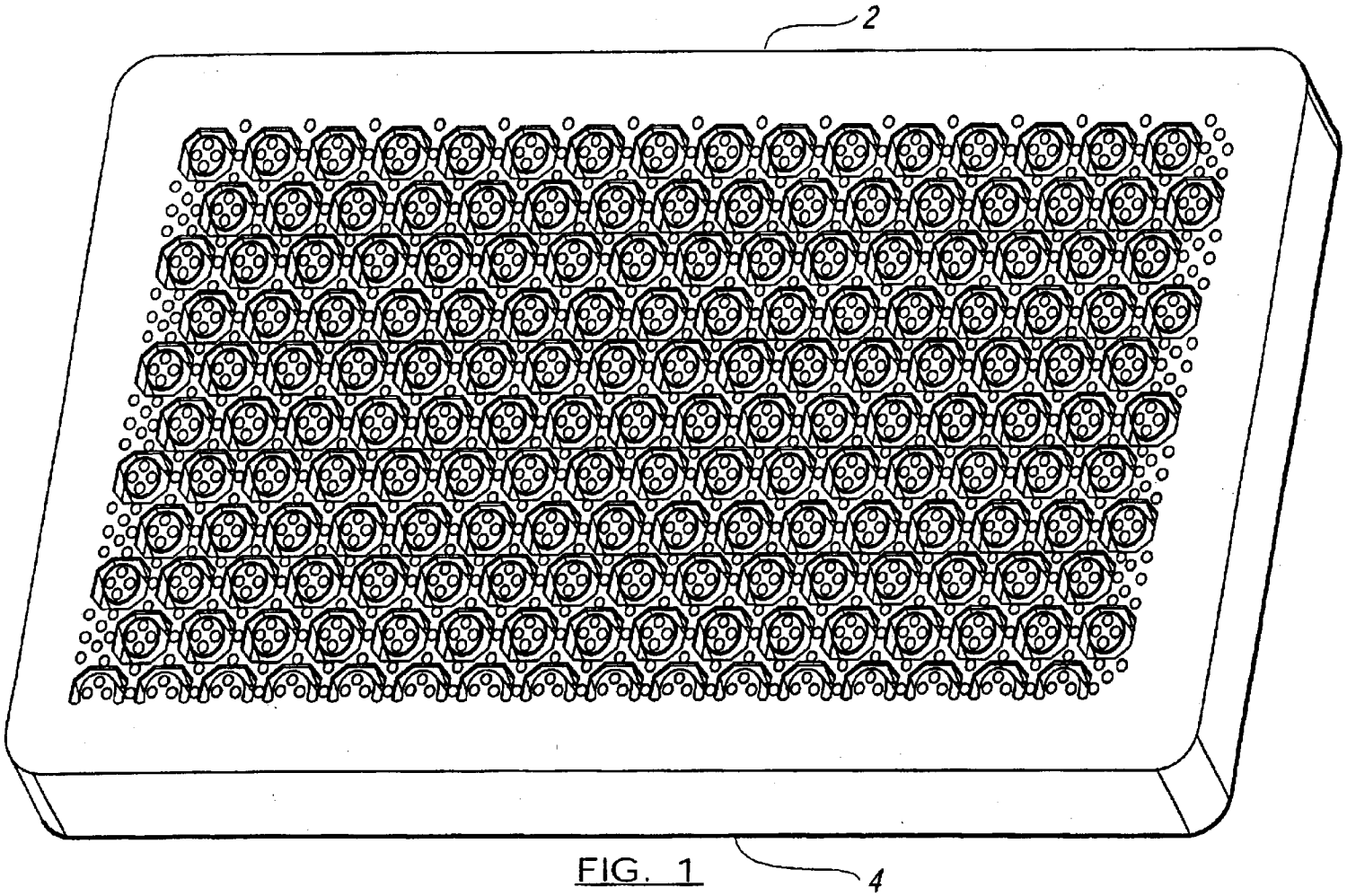
FIG. 1 shows a perspective view of a burner plaque according to the invention.

It is a first object of this invention to provide a burner plaque, and a burner plaque and distribution plate combined configuration which through its design reduces the propensity of burner incorporating said plaque to develop resonant noise.

A major consideration in plaque design is the facility for modulation. Historically burners within boilers were designed for simple binary or on/off operation. More recently environmental pressures and European Standards have demanded a higher degree of efficiency and therefore a much greater degree of control over the output of boilers. The majority of modern high efficiency boilers which are currently being used and developed incorporate a facility for modulating the gas/air supply to allow for changes in the heat requirement, i.e. increasing/decreasing the flow rate of the gas/air mixture (for a fixed aeration level). Currently, conventional metal burners having ports integrally formed therewith cannot offer the "turndown" range (the range over which the flame is stable on or proximate the surface of the burner as the gas/air flow is gradually reduced) demanded by manufacturers of high turndown range modulating appliances, and therefore ceramic and other high temperature materials materials are used in such applications.

There are two considerations relevant to modulation which must be taken into account, and both are related to the difficulty of maintaining a stable flame when providing a variable gas/air mixture flow rate, and thus a variable port loading, at the extremes of this variation of port loading.

The first consideration is that all burner plaques have a propensity to "light back" at low port loadings. This is manifested in the rearward burning of a flame into the body of a burner which can damage the burner and the boiler system. It is therefore essential to design a plaque on which the flame can burn at lower port loadings without light back. The propensity of a burner plaque to permit light back can be reduced by including ports of a quenching diameter or length.

The second consideration is the propensity of the flame to "lift-off" at high port loadings. This is manifested in the total or partial elevation of the base of the flame away from the burner port. Liftoff limits the burner applications as the surface of the plaque cannot be supplied with a sufficient volume of gas/air mixture to maintain a stable flame front.

The stability of the flame on the burner plaque surface is dependent on the open area of the plaque (port area per unit area of the plaque), the surface area "land" surrounding each port including the land within the port, i.e. the length of the ports, the pattern of ports, the profile of the plaque surface, the pattern of apertures in the distribution plate disposed behind the plaque in the burner and the open area of said distribution plate. A stable flame requires sufficient "land" to anchor itself thermally to the port, but this requirement compromises the total open area of the plaque and hence increases the port loading, with the attendant disadvantages of lift-off mentioned above. There is therefore a trade off between these two parameters.

The $NO_x$ (Nitrogen Oxide) and CO (Carbon Monoxide) emissions need to be controlled to meet regulatory environmental standards. Control over emissions is achieved by ensuring that a homogenous, evenly distributed gas/air mix of an optimum aeration is supplied to the burner.

This optimum aeration influences the peak flame temperature and the flame profile, a high flame temperature increases Nox and an unformed flame profile is an indicator of bad combustion, which causes CO formation.

The design of the plaque and the distribution plate also influence emissions, rounded surfaces create less fluid drag and disturbances than sharp edges, thereby minimising flame impingement with other flames and/or cold surfaces. Minimising the height and depth of profiles on the top flame bearing surface of the plaque reduces the likelihood of hotspots forming along with the detrimental effect these have on Nox.

The distribution plate can be used to reduce the gas flow to the edge ports of the burner where the flames are most likely to lift as they are not thermally supported on all sides. Lifted flames can lead to flame impingement and bad combustion.

It is a further object of this invention to provide a burner plaque, and a burner plaque and distribution plate combination, which is capable of reducing the propensity of a burner in which said plaque is incorporated to develop resonance, and which furthermore broadens the turn-down range and flame retention characteristics of a burner while nevertheless preventing light-back. It is further desired to achieve these objects without increasing the CO or $NO_x$ emissions of the burner or burner/distribution plate combination.

In terms of relevant prior art, U.S. Pat. No. 4,508,502 to Itoh describes a burner plaque having a two sets of diagonally orientated grooves or channels provided in the surface of the plaque which intersect with one another at various locations. These channels are aligned and coincidental with corresponding lines of burner ports provided in the plaque and thus the channels reduce the effective depth of those burner ports with which there are coincidental. JP60-086317 in the name of Matsushita Denki Sangyo IRK describes a similar burner plaque. Additionally, EP810404 in the name of the applicant herefor describes a burner plaque in which recess are provided which are coincidental with certain predetermined burner ports to reduce the effective depth of those burner ports. The recesses are discrete and not interconnected and therefore coincide with only individual burner ports.

According to the invention there is provided a burner plaque of ceramic or other high temperature material having a plurality of burner ports permitting the flow of combustible fluid from a first face of the plaque disposed towards the inside of a mixing chamber and a second face on which combustion of the fluid occurs, said burner ports being arranged in rows offset from one another in alternating fashion over a substantial portion of the faces of the plaque, said first and second faces defining the thickness of the plaque, said second face being provided with a plurality of channels which define discrete lands therebetween, said channels opening out in the second face of the plaque but having their, lowermost edges within the body of said plaque, the depth of said channels being less than the thickness of the plaque and the arrangement of said channels over the second face of said plaque being chosen to ensure that each of said channels coincides with at least two burner ports in the plaque to reduce the effective length of those ports, characterised in that It is yet further preferable that one or more burner ports open into the second surface of the plaque within the lands defined by the channels.

It is most preferable that the width of the channels progressively increases from their base so as to impinge into the cross-sectional area of one or more of those burner ports which open into the second surface of the plaque within said lands defined by said channels. This results in the said burner ports having an elliptical opening which is inclined at the same degree as the incline of the channel from its base.

Preferably the burner ports are arranged in rows offset from one another in alternating fashion over a substantial portion of the entire surface of the burner plaque.

Most preferably, channel shapes are provided in the second surface of the said plaque in rows offset or staggered with respect to one another.

It is yet further preferable that the channel shapes are arranged in rows offset from one another in alternating fashion over a substantial portion of the entire surface of the burner plaque.

It is ideally preferable that the distance between external edges of the channel shapes on either side of their geometric centers is greater than one half of the distance between the geometric centers of adjacent channel shapes in the same row, at least in one of the x-y directions over the surface of the plaque. Most preferably, the distance between the geometric centers of adjacent channel shapes is uniform in any row. the channels define a plurality of annular or polygonal shapes in the second surface of the plaque, each of said shapes having a continuous periphery so as to be separate from one another.

Preferably the shapes defined by the channels are arranged in rows.

Preferably the distance between opposite external sides of the shapes defined by said channels on the second face of said plaque is greater than one half of the distance between the geometric centres of two adjacent shapes defined by said channels in the same row in at least in one of the x or y directions over the second face of said plaque.

Preferably the shapes defined by said channels are arranged in consecutive rows which are offset or staggered with respect to one another over the said second face of said plaque.

Most preferably the burner plaque is composed of a ceramic based material.

Preferably said channels are of a width at their base marginally greater than the diameter of at least some of the ports in the plaque.

Most preferably the channel shapes are multi-directional, by which is meant that their shapes have portions extending in more than a single direction, and preferably the channel shape is octagonal.

Preferably the width of the channels progressively increases from their base such that the width of the channel at the second surface is greater than that at the base of the channel within the body of the plaque.

It is yet further preferable that one or more burner ports open into the second surface of the plaque within the lands defined by the channels.

It is most preferable that the width of the channels progressively increases from their base so as to impinge into the cross-sectional area of one or more of those burner ports which open into the second surface of the plaque within said lands defined by said channels. This results in the said burner ports having an elliptical opening which is inclined at the same degree as the incline of the channel from its base.

It is yet further preferable that the channels are arranged in rows offset from one another in alternating fashion over a substantial portion of the entire surface of the burner plaque.

Most preferably, the distance between the geometric centers of adjacent channel shapes is uniform in any row.

Preferably the plaque of the present invention is provided with a distribution plate having a plurality of apertures therein and defining with the first surface of said plaque a chamber. Most preferably, the ratio of burner port area to aperture area in said back plate is greater than 5.

The concept of providing a distribution plate aperture area of less than ⅓ that of the burner port area is that the back plate can act as a baffle for the gas/air mixture, and most preferably the distribution plate design is matched to the overall design of the burner plaque, chamber and mounting unit in which said plaque and distribution plate are disposed. The matching of the distribution plate to the plaque is important because too great an aperture area will allow pressure differentials (which are desired to break up the uniformity of flow on the surface of the plaque which it is believed induces resonance) to dissipate in the chamber, and too small an aperture area in comparison to the burner port area will reduce the capacity of the burner as insufficient gas/air mixture will be supplied through the burner ports and the fluid flow will be concentrated thus increasing the velocity thereof such that a stable flame cannot be retained on the second surface of the plaque. The burner plaque and distribution plate combination is therefore an independent aspect of this invention.

Preferably the arrangement of apertures in the distribution plate is substantially the same and coincidental with the arrangement of the geometric centers of the channel shapes provided in the second surface of the plaque. This has the desired effect of enhancing the influence of the multi-directional units by localising the distribution of fluid flow over them in effect slightly increasing the velocity through the units, a similar effect can be achieved by decreasing the thickness of the plaque.

Therefore the back plate acts as a baffle to the oncoming gas/air mixture, encouraging further mixing and distribution of the fluid flow evenly over the whole first surface of the plaque in alignment with the position of the multi-directional unit pattern on the second surface of the plaque, and ultimately flow through the ports therein.

With the configuration described above, at least in one x-y direction over the surface of the plaque, the extremities of channel shapes in one particular row encroach into the boundaries of channel shapes in immediately previous and following rows. It is believed that this interruption of uniformity over the surface of the plaque prevents shock waves from traveling over the surface of the plaque in that particular direction. Accordingly burner resonance can be reduced.

Indeed the provision of the channels themselves, regardless of their particular shape, size and configuration, represents a significant development because although recesses and channels have been considered in the existing art, the similarity of the width of the base channel to the diameter of the burner ports prevents or significantly inhibits the formation of vortices within the channel. Minimising the land around the ports at the base of the channel, tapering the channel to form a curved surface which naturally complements the shape of the flame and avoiding sharp edges all enhance smooth flow, reduce vortex shedding or shockwave formation.

Referring firstly to FIG. 1, there is shown a plaque 2 ideally adapted to be mounted in a burner plaque holder (not shown) having an aperture of marginally smaller dimensions than the plaque 2, said aperture being defined by a lip behind which the edges of the plaque 2 are retained. The holder is additionally provided with an apertured plate behind a lowermost surface 4 of the plaque, said apertures being disposed in said plate in a uniform row pattern, ideally matching the pattern of burner ports in the plaque.

Figure 2:
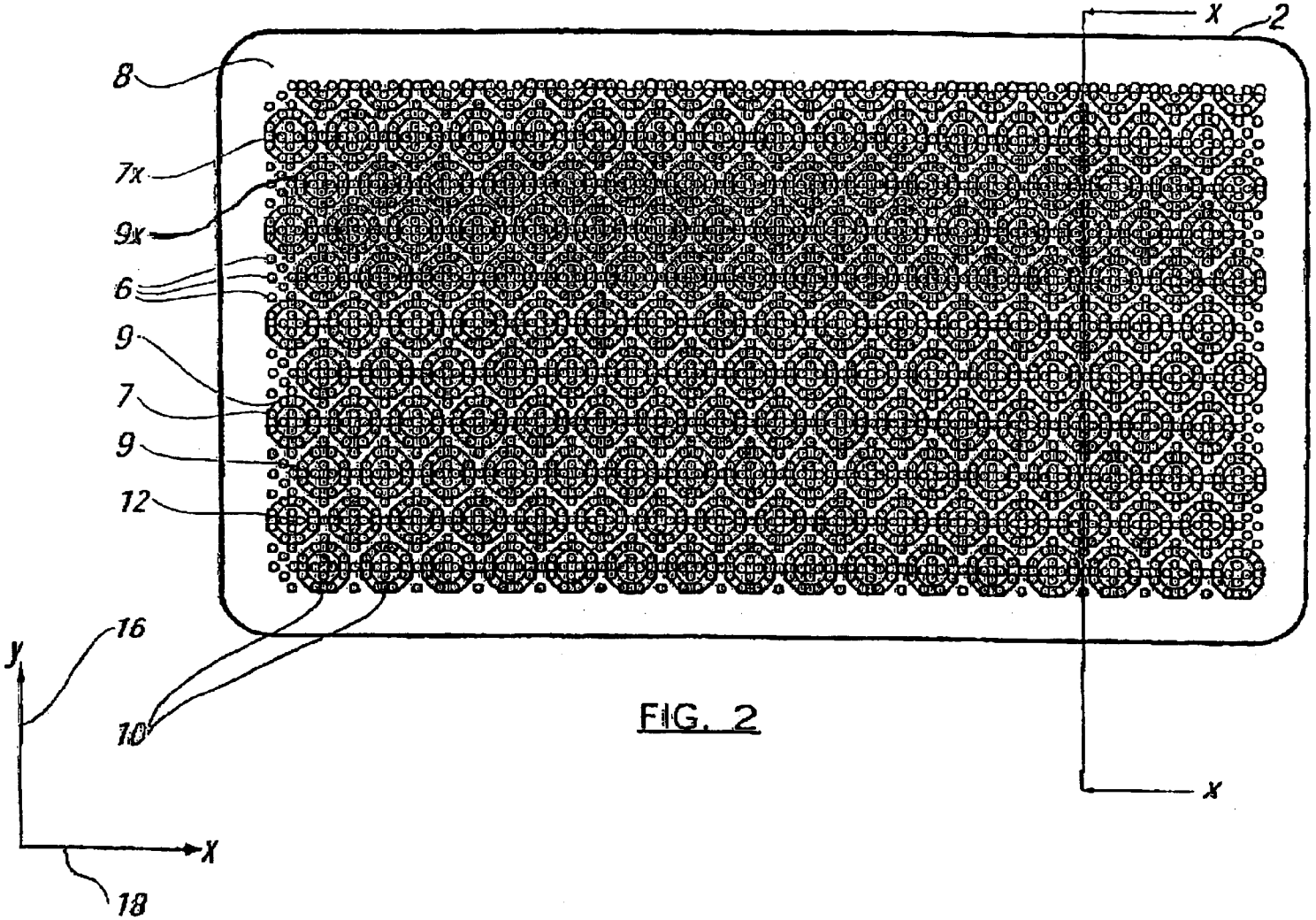
FIG. 2 shows a plan view of the plaque of FIG. 1.

Referring to FIG. 2 there is shown a plan view of the plaque 2 having a plurality of apertures 6 therein arranged in repeating rows 7, 9 over substantially the entire upper surface 8 of the plaque. The spacing between each aperture 6 in each row may be either exactly twice the amount of offset between any two adjacent rows or alternatively the spacing between adjacent apertures in a particular row may intermittently vary along the row as may the amount of offset between two adjacent rows over the surface of the plaque.

In one embodiment, rows 9 are offset by a distance which is substantially equal to half the distance between an adjacent pair of apertures in any particular row, and the various spacing distances between apertures and rows is chosen such that a pattern of polygonally shaped channels 10 can be provided spanning four consecutive rows, the width of said channels at their base within the plaque being similar to or marginally greater than the diameter of the apertures themselves, as shown in the Figure. Each channel 10 defines within its perimeter a land 12, and the dimensions of each channel and their relative position is such that there are rows of channel shapes 7X, 9X which are offset by a distance substantially equal to half the width of a particular channel in the x-direction 18 in which the rows 7X, 9X are defined.

The offset is such that the adjacent channel shapes in the corresponding rows in the y-direction 16 are interspersed by portions of the channel shapes provided in the rows immediately before and after any particular row.

The offset of the rows of channel shapes is thus important because it can be seen, at least from FIG. 2, that the outer peripheries of channel shapes in defined row 7X are inset within the outer peripheries of the channel shapes defined in adjacent row 9X. Thus in the y-direction indicated at 16 at least, shock waves which often travel up and down the burner during operation and which are thought to contribute significantly to the propensity of the burner to produce resonant noise are prevented from such travel by virtue of the offset of the individual "flame units" which are created above each channel shape and land disposed therein.

In FIG. 2, it can be seen that the rows of channel shapes extending in the x-direction are not encroached upon by the channel shapes in adjacent rows, although this is certainly possible. In such a configuration it would be possible to limit sound waves from travelling along the surface of the burner in either the x or y directions.

Figure 3:
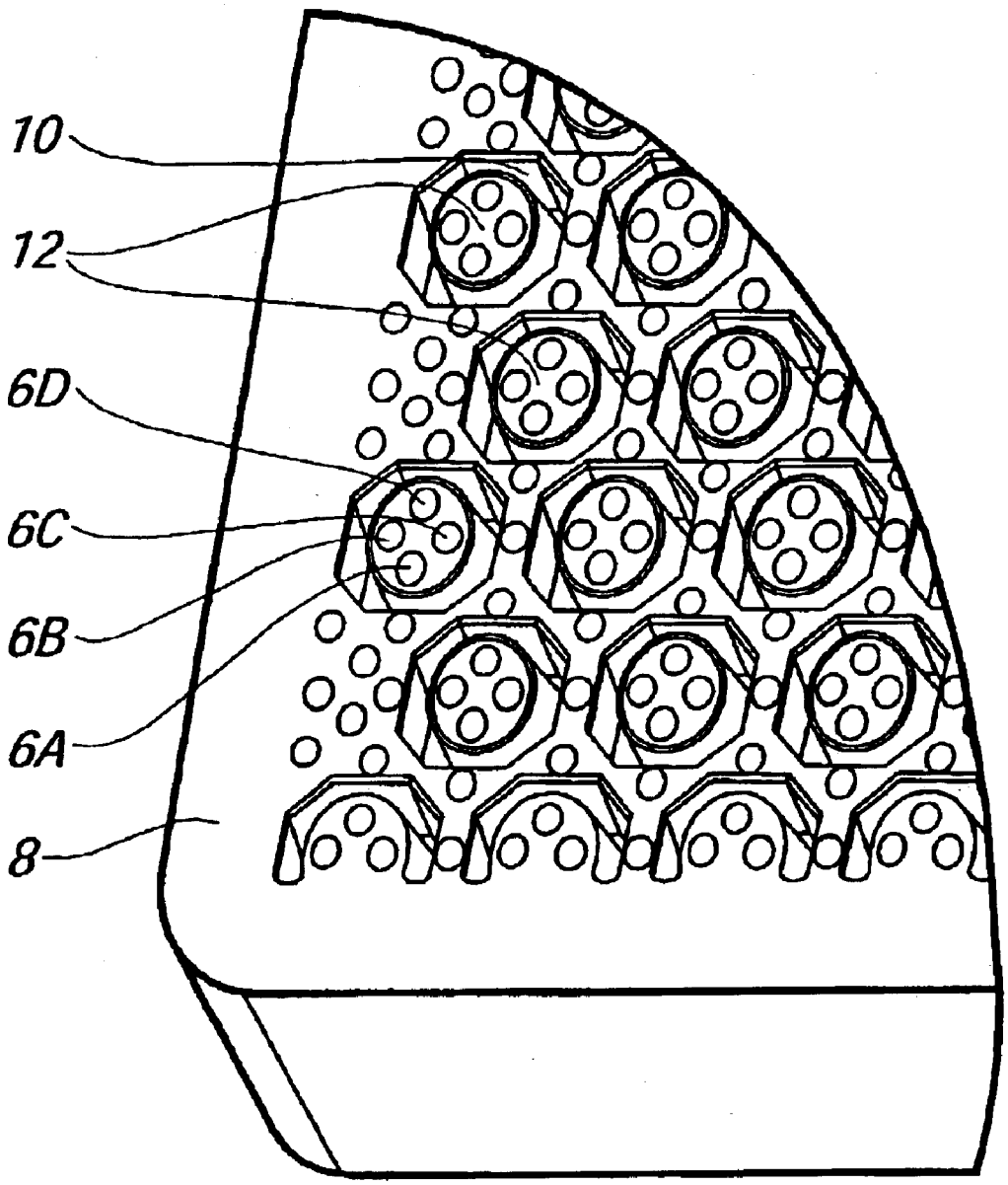
FIG. 3 shows an enlarged perspective view of a corner of the plaque of FIG. 1.

The arrangement is better seen with reference to FIG. 3 where it is clearly seen that the lands 12 are defined by octagonal channels 10 and are provided with four apertures 6A, 6B, 6C, 6D which open into the upper surface 8 of the plaque. The width of the channels 10 is substantially the same as the diameters of the apertures which is uniform over the entire area of the plaque, and the channels shapes and locations are chosen, in this embodiment at least, such that the apertures which open into the bases of the channel defined within the body of the plaque are situated at the vertices of the octagonal channel shapes.

It is conceived by the inventor that the channel width may increase from the base of the channel, where the width is substantially similar to the diameter of the apertures, as said channel becomes shallower. Either side wall of the channel may remain substantially vertical with the opposite wall being inclined our curved away therefrom, or both side walls may be so inclined or curved. Indeed the degree of inclination or curve may be such that the channel side walls encroach into the apertures 6A, 6B, 6C, 6D disposed within the lands 12, or remaining apertures 9 which open into the upper surface 8 of the plaque. These apertures would then have inclined elliptical or inclined, partially elliptical peripheries in the surface of the inclined or curved side walls of the channel, although in plan view, the aperture peripheries would appear circular as shown in FIG. 2.

Figure 5:
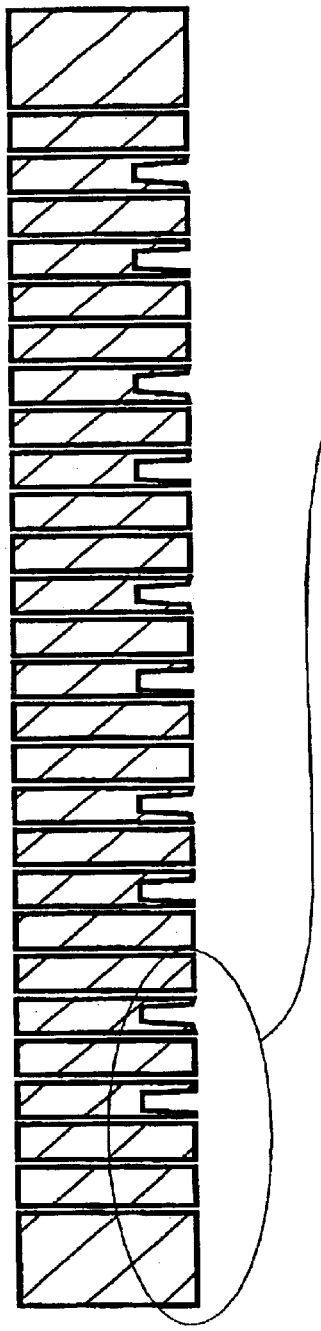
FIG. 5 shows a sectional view of the plaque of FIG. 1 across its width.

In FIG. 5 (which is the sectional view on X—X shown in FIG. 2), the depth of the channels is clearly seen.

Figure 6:
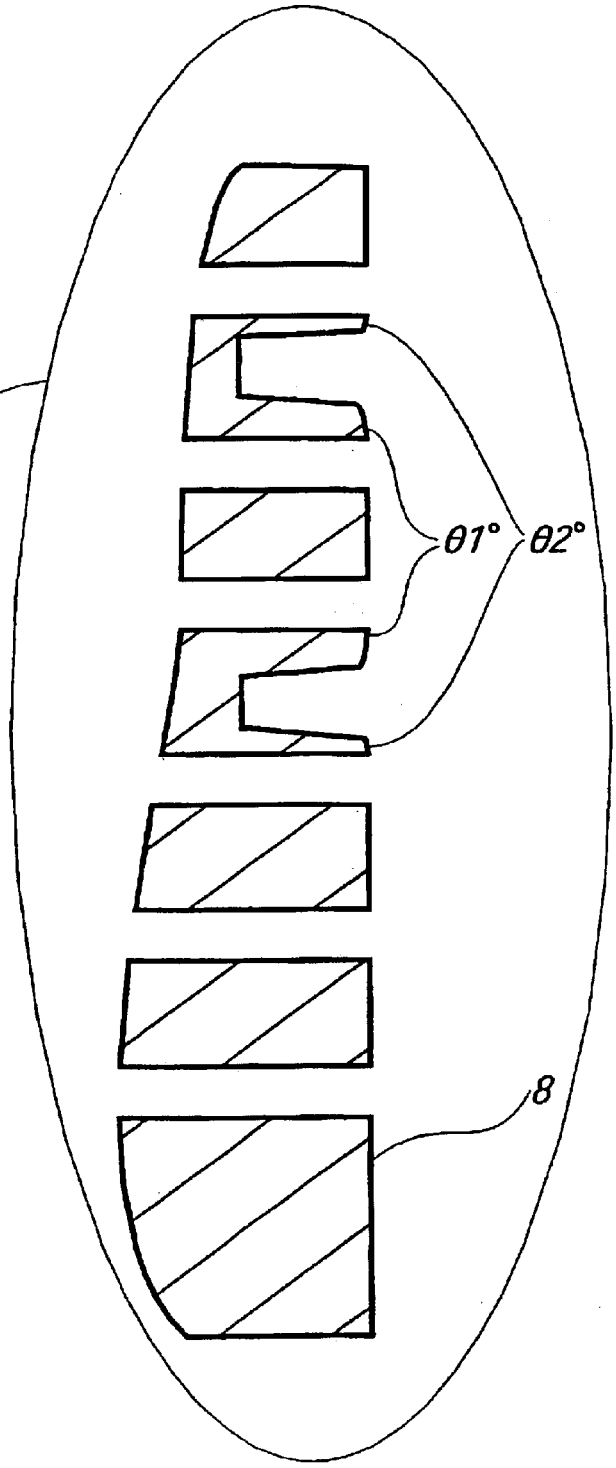
FIG. 6 shows an enlarged sectional view of the plaque of FIG. 5.

A sectional view of the plaque on X—X on FIG. 5 is shown in FIG. 6, and from this figure it can be seen that the channel width increases as it approaches the upper surface 8 of the plaque. It can be seen that both the inner and outer channel walls are inclined towards and away from the geometric centre of the particular channel shape respectively. In the embodiment shown θ1 and θ2 are the same but can also be different.

Figure 4:
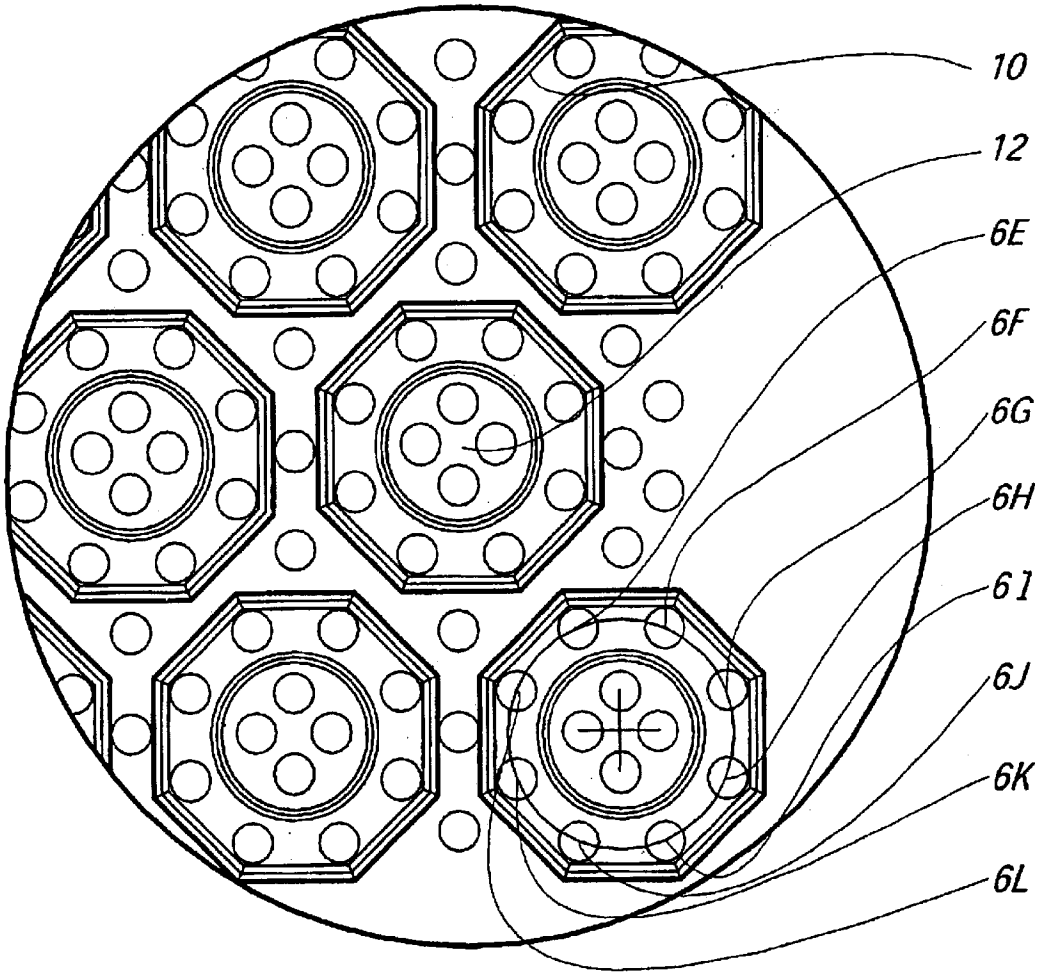
FIG. 4 shows an enlarged plan view of a corner of the plaque of FIG. 1.

The internal and external sides of the channel can also differ in shape for example by being round (circular) or angular (polyhedral) or be of the same shape forming a ring or octagon-see FIG. 4.

The ports emerging into the channel 6E, 6F, 6G, 6H, 6I, 6J, 6K, 6L are arranged radially equidistantly from the centre of a pitch circle diameter (PCD) shown in FIG. 4. The angle between radii joining the centre of the PCD and any two adjacent ports is 45°.

What is claimed is:

1. A burner plaque of ceramic or other high temperature material comprising a plurality of burn ports permitting flow of combustible fluid from a first face of the plaque disposed towards the inside of a mixing chamber and a second face of the plaque on which combustion of the fluid occurs, the burner ports being arranged in rows offset from one another in alternating fashion over a substantial portion of the first and second faces of the plaque, the first and second faces of the plaque defining the thickness of the plaque, the second face of the plaque being provided with a plurality of channels which define discrete lands therebetween, the channels opening out in the second face of the plaque but having a depth that is less than the thickness of the plaque and the arrangement of the channels over the second face of the plaque being chosen to ensure that each of the channels coincides with at least two burner ports in the plaque to reduce the effective length of the at least two burner ports, wherein the channels define a plurality of annular or polygonal shapes in the second face of the plaque, each of the channels having a continuous periphery so as to be separate from one another.

2. A burner plaque according to claim 1, wherein the channels are arranged in rows.

3. A burner plaque according to claim 2, wherein the distance between opposite external sides of two adjacent channels on the second face of the plaque is greater than one half of the distance between the geometric centres of the two adjacent channels in the same row.

4. A burner plaque a according to claim 1, wherein the channels are arranged in consecutive rows which are offset or staggered with respect to one another over the second face of the plaque.

5. A burner plaque according to claim 1, wherein each channel, at its greatest depth within the plague, has a width similar to a diameter of at least some of the burner ports.

6. A burner plaque according to claim 1, wherein a plurality of the channels each have an octagonal shape.

7. A burner plaque according to claim 1, wherein the width of each channel at the second face of the plaque is greater than the width of the channel at its greatest depth within the plaque.

8. A burner plaque according to claim 1, wherein one or more burner ports open into the second face of the plaque within the lands defined by the channels.

9. A burner plaque according to claim 8, wherein the width of the channels progressively increases from their greatest depth within the plaque to the second face of the plaque so that the channels impinge into the cross-sectional area of one or more of the burner ports which open into the second face of the plaque within the lands defined by the channels.

10. A burner plaque according to claim 1, wherein the distance between the geometric centres of adjacent channels is uniform in any row of channels.

11. A burner comprising a burner plaque according to claim 1 and further comprising a distribution plate having a plurality of apertures therein and defining with the first face of the plaque a chamber in which mixing of combustible fluid can occur after the combustible fluid has passed through the distribution plate.

12. A burner according to claim 11, wherein the ratio of burner port area in the plaque to aperture area in the distribution plate is greater than 5.

13. A burner according to claim 12, wherein the apertures in the distribution plate are arranged in a manner which is substantially the same and coincidental with the arrangement of the geometric centres of the channels provided in the second face of the plaque.

* * * * *

UNITED STATES PATENT AND TRADEMARK OFFICE

CERTIFICATE OF CORRECTION

PATENT NO. : 7,063,527 B2
APPLICATION NO. : 10/111309
DATED : June 20, 2006
INVENTOR(S) : Callum et al.

It is certified that error appears in the above-identified patent and that said Letters Patent is hereby corrected as shown below:

On the cover page,

[*] Notice: Subject to any disclaimer, the term of this patent is extended or adjusted under 35 USC 154(b) by (84) days Delete the phrase "by 84" and insert -- by 677 days--

Signed and Sealed this

Second Day of October, 2007

JON W. DUDAS
*Director of the United States Patent and Trademark Office*